US005581953A

United States Patent [19]

Ruff

[11] Patent Number: 5,581,953

[45] Date of Patent: Dec. 10, 1996

[54] METAL FRAME ASSEMBLY

[75] Inventor: Robert O. Ruff, Cincinnati, Ohio

[73] Assignee: Ingersoll-Rand, Phillipsburg, N.J.

[21] Appl. No.: 455,215

[22] Filed: May 31, 1995

[51] Int. Cl.[6] ..... E06B 1/16; E06B 1/22

[52] U.S. Cl. ..... 49/504; 52/204.1; 52/656.2; 52/656.4; 52/656.9; 52/730.2; 52/730.3; 52/730.4; 52/730.5; 52/736.2; 403/13; 403/242

[58] Field of Search ..... 52/211, 212, 213, 52/656.4, 656.5, 656.9, 730.2, 730.3, 730.4, 730.5, 736.2, 204.1, 656.2; 403/382, 401, 13, 14, 231, 242, 274; 49/504

[56] References Cited

U.S. PATENT DOCUMENTS

| | | | |
|---|---|---|---|
| 2,741,344 | 4/1956 | Herr . | |
| 2,869,695 | 1/1959 | Herr et al. | 52/656.4 X |
| 2,874,420 | 2/1959 | Henderson . | |
| 3,222,833 | 12/1965 | Woodrum . | |
| 3,287,857 | 11/1966 | Dukas | 52/656.4 X |
| 3,429,076 | 2/1969 | Fortsch et al. . | |
| 3,469,360 | 9/1969 | Peterson et al. | 403/401 X |
| 3,552,085 | 1/1971 | Woodrum . | |
| 3,769,773 | 11/1973 | Mochizuki . | |
| 4,513,549 | 4/1985 | Wendt | 52/211 |
| 4,669,343 | 6/1987 | Langenhorst | 52/211 |
| 4,719,729 | 1/1988 | Wynar | 52/211 |

OTHER PUBLICATIONS

Steel Door Institute "Nomenclature for Steel doors and Steel Door Frames" Dec. 14, 1989.

Steel Door Institute "The Standard Steel Door and Frame Story" Feb. 1, 1991.

Steelcraft "K. D. Frame Assembly And Installation For Open Steel Stud" Jul. 1980.

Steelcraft "Steel Doors, Frames and Entrance Systems" Aug. 1993.

*Primary Examiner*—Christopher T. Kent

*Attorney, Agent, or Firm*—Steven J. Rosen

[57] ABSTRACT

A metallic frame and the assembly from which it is constructed has a header and a jamb and a means to attach them together at a corner of the metal frame. The header and the jamb each have a soffit disposed inwardly from a rabbet and a stop extending substantially perpendicular to and between the rabbet and the soffit. One of either the header or jamb has terminal ends of a first soffit, a first stop, and a first rabbet that generally lie in the same plane with a first corner edge. A rail slot extends through a width of the corresponding first stop and thicknesses of the first soffit and the first rabbet. The other of the header and a jambs has track formed along a second rabbet between a terminal end of a second rabbet and a terminal end of a second stop and second soffit which are cut back and spaced a distance from the terminal end of the second rabbet such that the track and the rail slot are slidingly engageable.

17 Claims, 4 Drawing Sheets

METAL FRAME ASSEMBLY

BACKGROUND OF INVENTION

1. Field of the Invention

The present invention pertains to metal frames and frame assemblies for doors or other casings and in particular to means of attaching metal door and window frame headers to jambs.

2. Description of Related Art

The field of the present invention is the art of metal frames for openings, such as doors in buildings and the invention may also be applied to window frames and casings as well. More particularly, this invention relates to hollow sheet metal frames which can be easily installed by workmen in openings, such as the doorway in a new or an existing wall of a building. Typically simple tools, for example, a hammer, level, a square and screw driver are used for assembly installation. The frames may be delivered either assembled or in knockdown condition for field assembly at the job site. When assembled, the ends of the header and the adjacent ends of the jambs are arranged to be in close fitting relation and are secured together by means which prevent them from loosening up and ends from becoming dislodged. The engaged ends of the header and jamb resist distortion, dislodgement, and relative movement by reason of their interengagement and reinforcements therein. Metal doors are particularly suited for masonry wall construction.

U.S. Pat. Nos. 2,741,344, 3,429,076, and 3,552,085 are typical of the prior art techniques used to attach the door jambs and headers at their common ends at the upper corners of the frame. A problem encountered by architects and builders is crevices or openings between the soffit and stop surfaces of the mated jambs and headers of the assembled frames in the corner mitered joints. They are visible to people passing through the door, are an architectural eyesore that detracts from the aesthetic appeal of the doorway, and can be bent if accidently caught by or on something. Therefore it is highly desirable to have a mitered corner joint as well as a butted corner joint along the soffits of the mated jambs and headers that tightly attaches the header to the jamb and reduces or eliminates the openings between the soffits.

SUMMARY OF THE INVENTION

A metallic frame and the assembly from which it is constructed has a header and a jamb and a means attach the header and the jamb to each other at a corner of the metal frame. The header and the jamb each have a soffit disposed inwardly from a rabbet and a stop extending substantially perpendicular to and between the rabbet and the soffit. Either the header or the jamb has a first corner end with a straight rail slot set back from a first corner edge and cut through its corresponding first stop, first rabbet, and first soffit. Terminal ends of the first soffit, first stop, and first rabbet generally lie in the same plane with the first corner edge. The rail slot extends through a width of the corresponding first stop and thicknesses of the corresponding first soffit and the first rabbet. The other of the header and the jamb has a second corner end and its corresponding second stop and its corresponding second soffit have terminal ends that are set back a distance from its second corner edge which coincides with a terminal end of the rabbet. A track is formed along the second rabbet between the terminal end of the rabbet and the terminal end of the stop and the track and the rail slot are slidingly engageable.

One embodiment is designed to provide a mitered corner for the assembled frame in which the header and the jamb each have a mitered cut at the corner ends such that header and jamb faces extending perpendicularly from corresponding ones of the rabbets form a mitered joint at the corner of the frame. Preferably the track extends across a thickness of the second stop. The present invention may also be incorporated in a butted corner frame. A more particular embodiment includes at least one first bendable tab extending from the second corner end in a direction perpendicular to an assembled position of the first soffit, the assembled position being where the jamb and the header are assembled perpendicular to each other, at least one first tab slot adapted to receive the tab disposed through a surface of the first corner end, and the first tab slot disposed through a surface that is parallel to the assembled position of the first soffit. A more particular embodiment further includes at least one second bendable tab extending from the second corner end in a direction perpendicular to assembled position of the first soffit and perpendicular to the first bendable tab, at least one second tab slot adapted to receive the tab disposed through a surface of the first corner end, and the second tab slot disposed through a surface that is parallel to the assembled position of the first soffit.

ADVANTAGES

Among the advantages provided by the present invention is an easy to construct frame and its assembly that provides a tight and aesthetically pleasing interior corner of a metal frame and particularly of a metal door frame. The present invention provides a tight fit between frame header and jambs that reduces or essentially eliminates crevices or openings between soffit and stop surfaces of mated jambs and headers of the assembled frames in the frame corner particularly for mitered joints. Thus the inside corner joint of a frame assembly constructed in accordance with the present invention and which is visible to people passing through the door frame does not become an architectural eyesore that detracts from the aesthetic appeal of the doorway. The frame assembly of-present invention provides an inside corner that is more architecturally and aesthetic appealing than similar frames and frame assemblies found in the prior art.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
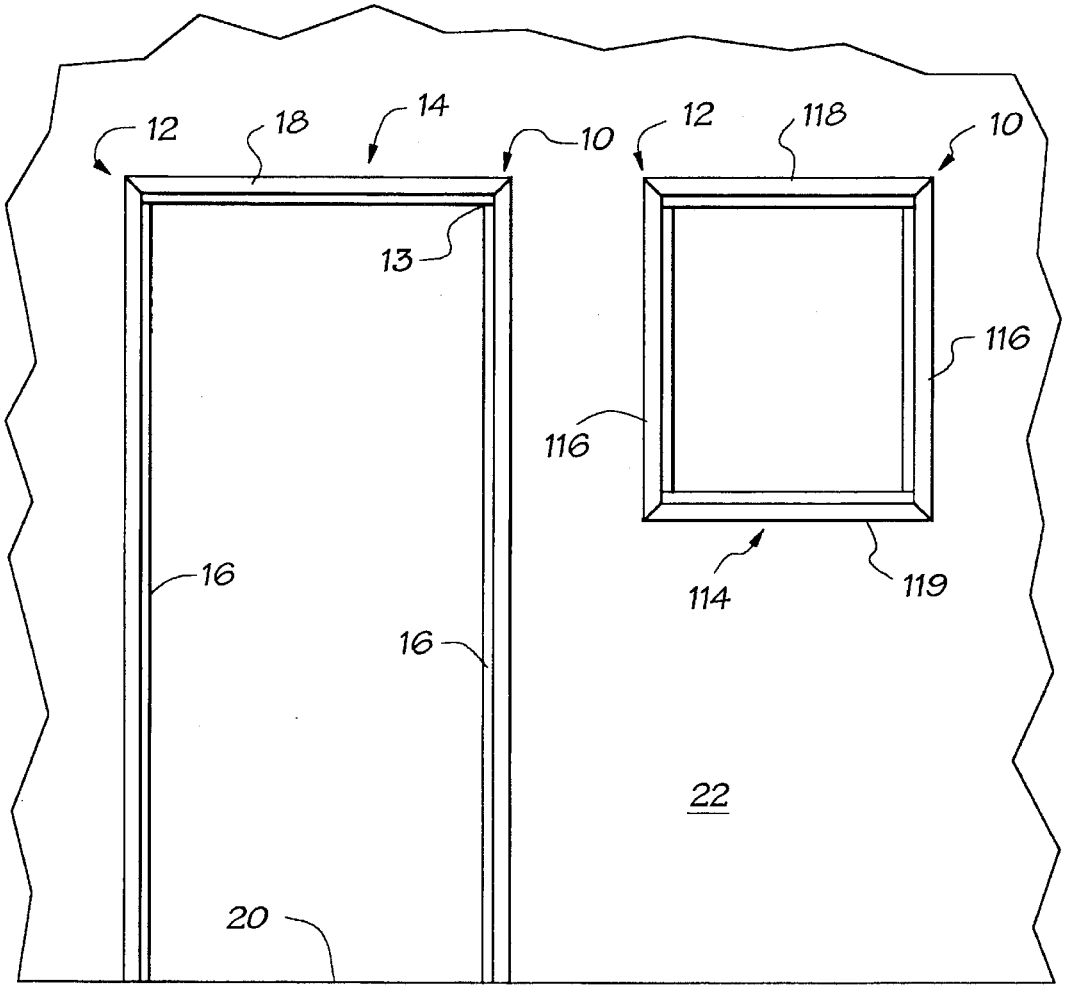
FIG. 1 is a perspective view illustrating an exemplary embodiment of a metal door frame and a metal window frame and assemblies in accordance with the present invention.
Figure 1A:
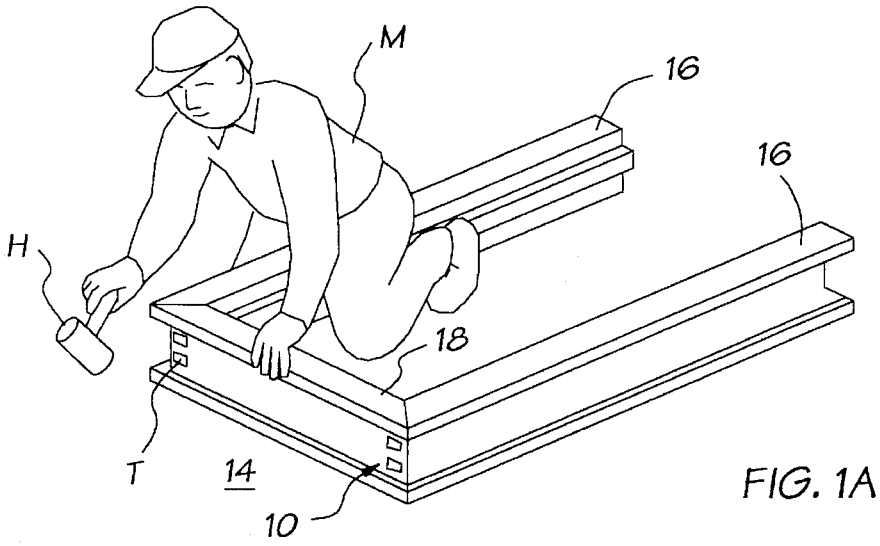
FIG. 1A is a perspective view illustrating assembly of the exemplary embodiment the metal door frame assembly in FIG. 1.

Illustrated in FIG. 1 is a connecting means 10 to attach a header 18 and a jamb 16 to each other at a corner 12 of a metal door frame 14. The metallic door frame 14 is constructed from an assembly illustrated herein as having a pair of opposed door jambs 16 and a connecting header 18 and rests on a floor 20 between typically masonry walls 22 that extend upward from the floor. The metallic door frame 14 is often either assembled prior to being sent to the job site or sent to the job site in knock down condition for assembly at the job site as illustrated in FIG. 1A prior to installation. The frame attachment means 10 was developed for a metal door frame 14 but may also be used for other frames such as window or panel frames. Further illustrated in FIG. 1 is a metallic window frame 114 that can use the connecting means 10 to attach a window header 118 and a window jamb 116 to each other at a corner 12 as well as a window sill 119 to each of the window jambs 116. Assembly of the window frame 114 is also done prior to its installation in the masonry wall 22. The nomenclature used herein is well known in the industry and essentially described in greater detail in the reference "Nomenclature for Steel Doors and Steel Door Frames" published by the Steel Door Institute and approved by the American National Standards Institute.

Figure 2:
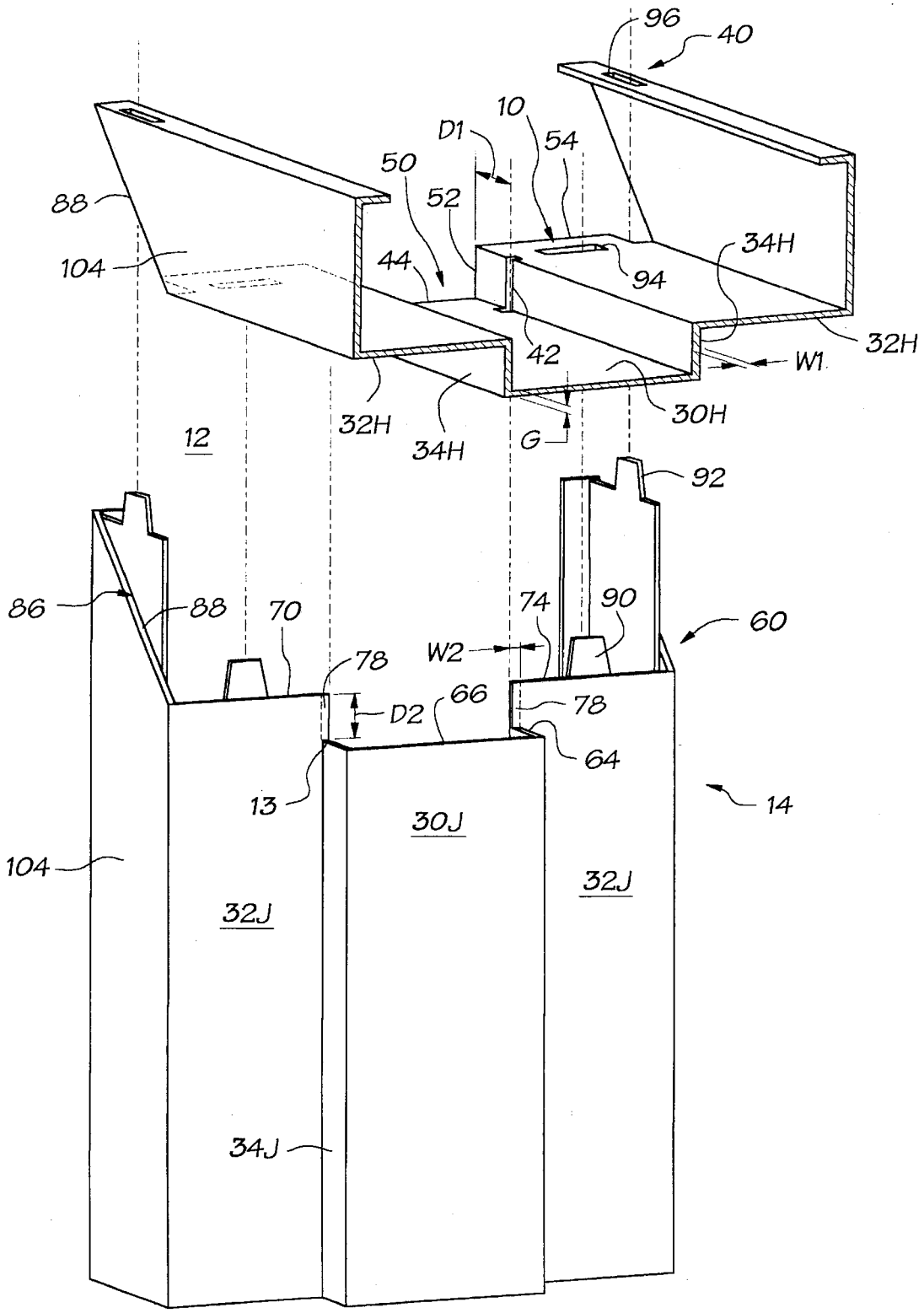
FIG. 2 is an enlarged exploded view of the corner of the assembly in FIG. 1.

Referring now to FIG. 2, the corner 12 of the frame 14 is where the header 18 and the jamb 16 meet and are attached by the connecting means 10. The jamb 16 has a jamb soffit 30J disposed inwardly from a jamb rabbet 32J and a jamb stop 34J extending substantially perpendicular to and between the jamb rabbet and the jamb soffit. The header 18 has a header soffit 30H disposed inwardly from a header rabbet 32H and a header stop 34H extending substantially perpendicular to and between the header rabbet and-the header soffit 30. The header 18 has a first corner end 40 with a straight rail slot 42 set back a first distance D1 from a first corner edge 44 and cut through its corresponding first stop, first rabbet, and first soffit which are shown as the header stop 34H, the header rabbet 32H and the header soffit 30H respectively.

A first soffit terminal end 50, a first stop terminal 52, and a first rabbet terminal end 54 all generally lie in the same plane and form part of the first corner edge 44. The rail slot 42 extends through a first width W1 of the corresponding first header stop 34H and through a metal thicknesses T of the corresponding header soffit 30H and header rabbet 32H. The jamb 16 has a second corner end 60 and its corresponding second stop which is the jamb stop 34J and its corresponding second soffit which is the jamb soffit 30J. The jamb stop 34J has a jamb stop terminal end 64 and the jamb soffit 30J has a jamb soffit terminal end 66 each of which are set back a second distance D2 from a second corner edge 70 which coincides with a jamb rabbet terminal end 74 of the jamb rabbet 32J.

Figure 3:
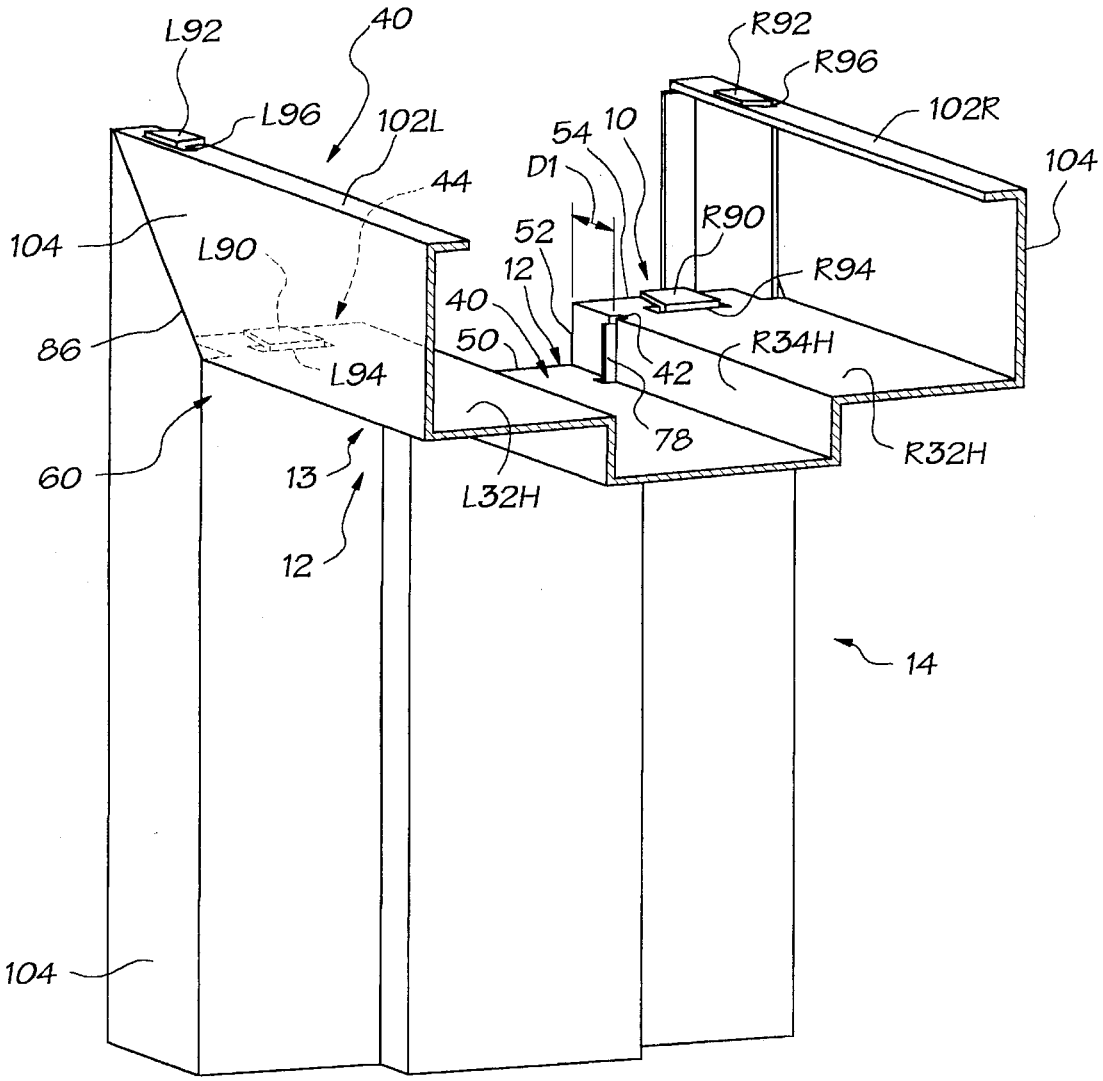
FIG. 3 is an enlarged view of the corner of the assembled frame in FIG. 1.

A track 78 having a second width W2 is formed along the jamb rabbet 32J between the jamb rabbet terminal end 74 and the jamb stop terminal end 64 such that the track 78 and the rail slot 42 are slidingly engageable. This allows the header 18 and the jamb 16 to easily fitted together and adjusted during assembly at the corner 12 of the metal door frame 14. This further provides a tight fit between the header 18 and the jamb 16 particularly at an inside visible corner 13 of the frame 14. It also provides a means to simultaneously adjust the header and jamb at the corner 12 to provide a smooth mitered corner 12 as illustrated in FIG. 3. Referring still to FIG. 2, the second width W2 of the track 78 preferably extends across the metal thickness T of the jamb stop 34J also referred to as the second stop. Typically in prior art frames there are no slots and no tracks and the metal which is used in this invention to form the rail stops or is cut off at the stop.

First and second bendable tabs 90 and 92 respectively extend from the second corner end 60 in a direction perpendicular to an assembled position of the first soffit which is the header soffit 30H, the assembled position being when the jamb 16 and the header 18 are assembled perpendicular to each other as illustrated in FIGS. 2 and 3, The first and second bendable tabs 90 and 92 respectively provide a means to secure the header 18 to the jamb 16. The first corner end 40 has first and second tab slots 94 and 96 respectively adapted to receive the first and second bendable tabs 90 and 92 respectively. The first and second tab slots 94 and 96 respectively are disposed through surfaces of the first corner end 40 that are parallel to the assembled position of the first soffit which is the header soffit 30H in FIGS. 2 and 3.

Illustrated in FIG. 3 is the corner 12 of the assembled metal door frame 14 showing left and right hand first bendable tabs L90 and R90 respectively disposed through corresponding left and right hand first tab slots L94 and R94 respectively which are located on left and right hand header rabbets L32H and R32H respectively. The left and right hand first bendable tabs L90 and R90 are outwardly bent over the corresponding left and right hand header rabbets L32H and R32H respectively. Left and right hand second bendable tabs L92 and R92 respectively are disposed through corresponding left and right hand second tab slots L96 and R96 respectively which are located on left and right hand header backbends 102L and 102R respectively. The left and right hand second bendable tabs L92 and R92 are inwardly bent over the corresponding left and right hand header backbends 102L and 102R respectively. Bending of the tabs is illustrated in FIG. 1A which shows a workman M bending tabs T with a hammer H prior to the frame 14 being installed in the masonry wall 22 in FIG. 1.

Figure 4:
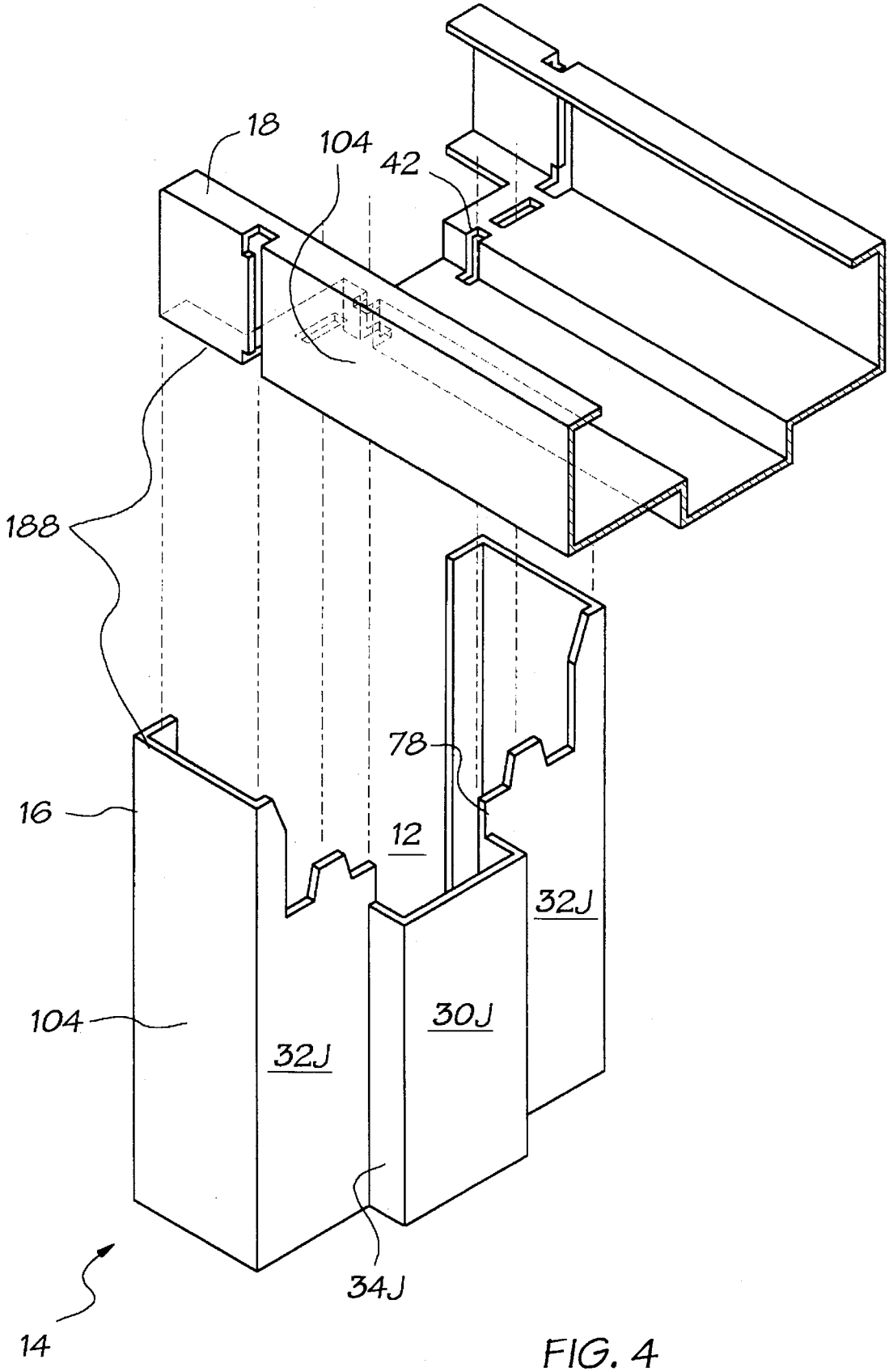
FIG. 4 is a perspective view illustrating an embodiment of the present invention having a butted corner.

The corner 12 is illustrated as being mitered and having a mitered joint 86 in which the header 18 and the jamb 16 have 45 degree mitered cuts 88 along the faces 104 of the header 18 and the jambs 16 at their respective corner ends. However, as illustrated in FIG. 4, the present invention may also be used in the corner 12 of frame 14 which has a butted end joint 186 with 90 degree end cuts 188 along the faces 104 of the header 18 and the jambs 16 at their respective corner ends. The bendable tabs may have to be located differently but the straight rail slot 42 and the track 78 remain essentially the same. Screws or welds may be used in the place of or in conjunction with the bendable tabs to provide a means to secure the header 18 to the jamb 16.

While the preferred embodiment of the present invention has been described fully in order to explain its principles, it is understood that various modifications or alterations may be made to the preferred embodiment without departing from the scope of the invention as set forth in the appended claims.

I claim:

1. A metal frame assembly comprising;

a header and a jamb which are operable to be attached to each other at a corner of the metal frame assembly, said header and said jamb each have a soffit disposed inwardly from a rabbet and a stop extending substantially perpendicular to and between said rabbet and said soffit, one of said header and said jamb has a first corner end with a straight rail slot set back from a first corner edge and cut through a corresponding first stop, first rabbet, and, first soffit of said one of said header and said jamb wherein first terminal ends of said first soffit, first stop, and first rabbet generally lie in a plane with the first corner edge, said rail slot extends through a width of said corresponding first stop and thicknesses of corresponding said first soffit and said first rabbet, said other of said header and said jamb has a second corner end with a second stop and a second soffit having second terminal ends that are set back a distance from a second corner edge which coincides with a rabbet terminal end of a second rabbet of said other of said header and said jamb, a track is formed along said second rabbet between said rabbet terminal end of said second rabbet and said second terminal end of said second stop, and said track and said rail slot are slidingly engageable.

2. A metal frame assembly as claimed in claim 1 wherein said header and said jamb each have a mitered cut at said corner ends such that said header and said jamb include header and jamb faces respectively, which extend perpendicularly from corresponding ones of said rabbets to form a mitered joint at said corner of the assembly when assembled.

3. A metal frame assembly as claimed in claim 1 wherein said header and said jamb each have a 90 degree cut at said corner ends such that said header and jamb faces extend perpendicularly from corresponding ones of said rabbets to form a butted joint at said corner of the assembly when assembled.

4. A metal frame assembly as claimed in claim 1 wherein said track extends across a thickness of said second stop.

5. A metal frame assembly as claimed in claim 4 further comprising;

at least one first bendable tab extending from said second corner end in a direction perpendicular to an assembled position of said first soffit, said assembled position comprising said jamb and said header assembled perpendicular to each other, at least one first tab slot adapted to receive said tab and disposed through a first surface of said first corner end, and said first surface is parallel to said first soffit.

6. A metal frame assembly as claimed in claim 5 further comprising;

at least one second bendable tab extending from said second corner end in a direction perpendicular to an assembled position of said first soffit and perpendicular to said first bendable tab, at least one second tab slot adapted to receive said second tab and disposed through a second surface of said first corner end, and said second surface is parallel to said first soffit.

7. A metal frame assembly as claimed in claim 6 wherein said first surface is on said first rabbet of said first corner end.

8. A metal frame assembly as claimed in claim 7 wherein said second surface is on said first corner end on a portion of a backbend extending perpendicularly inward from a face that is perpendicular to said rabbet of said first corner end.

9. A metal frame assembly as claimed in claim 6 wherein said header and said jamb each have a mitered cut at said corner ends such that header and jamb faces extend perpendicularly from corresponding ones of said rabbets forming a mitered joint at said corner of the assembly when assembled.

10. A metal frame comprising;

a header and a jamb connected to each other at a corner of the metal frame, said header and said jamb each have a soffit disposed inwardly from a rabbet and a stop extending substantially perpendicular to and between said rabbet and said soffit, one of said header and said jamb has a first corner end with a straight rail slot set back from a first corner edge and cut through a corresponding first stop, first rabbet, and, first soffit of said one of said header and said jamb wherein first terminal ends of said first soffit, first stop, and first rabbet generally lie in a plane with said first corner edge, said rail slot extends through a width of said corresponding first stop and thicknesses of corresponding said first soffit and said first rabbet, said other of said header and said jamb has a second corner end with a second stop and a second soffit having second terminal ends that are set back a distance from second corner edge which coincides with a rabbet terminal end of a second rabbet of said other of said header and said jamb, a track is formed along said second rabbet between said rabbet terminal end of said second rabbet and said second terminal end of said second stop, and said track is slidingly disposed in said rail slot.

11. A metal frame as claimed in claim 10 wherein said header and said jamb each have a mitered cut at said corner ends such that said header and said jamb include header and jamb faces respectively, which extend perpendicularly from corresponding ones of said rabbets to form a mitered joint at said corner of the frame.

12. A metal frame as claimed in claim 10 wherein said header and said jamb each have a 90 degree cut at said corner ends such that said header and said jamb include header and jamb faces respectively, which extend perpendicularly from corresponding ones of said rabbets forming a butted joint at said corner.

13. A metal frame as claimed in claim 10 wherein said track extends across a thickness of said second stop.

14. A metal frame as claimed in claim 10 further comprising;

at least one first bendable tab extending from said second corner end through a first tab slot in a first surface of said first corner end, said first bendable tab bent over said first surface, and said first surface is parallel to said first soffit.

15. A metal frame as claimed in claim 14 further comprising;

at least one second bendable tab extending from said second corner end through at least one second tab slot in a second surface of said first corner end, said one second tab slot being perpendicular to said first tab slot, said second bendable tab bent over said second surface, and said second surface is parallel to said first soffit.

16. A metal frame as claimed in claim 15 wherein said first surface is on said rabbet of said first corner end.

17. A metal frame as claimed in claim 16 wherein said second surface is on said first corner end on a portion of a backbend extending perpendicularly inward from a face that is perpendicular to said rabbet of said first corner end.

* * * * *